US008915764B2

(12) United States Patent
Scott et al.

(10) Patent No.: US 8,915,764 B2
(45) Date of Patent: Dec. 23, 2014

(54) BRA WITH EMBROIDERED SUPPORT REGIONS

(71) Applicant: Nike, Inc., Beaverton, OR (US)

(72) Inventors: Stephanie J. Scott, Portland, OR (US); Laura Tempesta, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/836,153

(22) Filed: Mar. 15, 2013

(65) Prior Publication Data

US 2014/0273740 A1 Sep. 18, 2014

(51) Int. Cl.

| | |
|---|---|
| ***A41C 3/00*** | (2006.01) |
| ***A41C 3/12*** | (2006.01) |
| *A41C 5/00* | (2006.01) |

(52) U.S. Cl.

CPC ..... *A41C 3/12* (2013.01)
USPC ..... 450/53; 450/92

(58) Field of Classification Search

USPC ..... 450/39, 92, 93, 90, 53–57, 40, 43, 44
See application file for complete search history.

(56) References Cited

U.S. PATENT DOCUMENTS

| | | | | | |
|---|---|---|---|---|---|
| 2,078,099 | A | * | 4/1937 | Rotelli et al. | 450/53 |
| 2,335,430 | A | * | 11/1943 | Metz | 450/19 |
| 2,469,654 | A | * | 5/1949 | Kriz | 450/90 |
| 2,562,582 | A | * | 7/1951 | Schaumer | 450/70 |
| 2,629,099 | A | * | 2/1953 | Phillips | 450/90 |
| 2,657,038 | A | * | 10/1953 | Emerson | 267/123 |
| 2,753,564 | A | * | 7/1956 | Verreault | 450/90 |
| 2,753,565 | A | * | 7/1956 | Hölscher | 450/72 |
| 2,781,518 | A | * | 2/1957 | Verreault | 450/90 |
| 2,830,590 | A | * | 4/1958 | Verreault | 450/42 |
| 2,866,463 | A | * | 12/1958 | Verreault | 450/90 |
| 4,073,299 | A | * | 2/1978 | Murata | 450/1 |
| 4,080,416 | A | * | 3/1978 | Howard | 264/258 |
| 6,374,643 | B2 | * | 4/2002 | Orima | 66/193 |
| 6,837,772 | B1 | * | 1/2005 | Luk | 450/51 |
| 6,878,033 | B2 | * | 4/2005 | Luk | 450/39 |
| 7,815,487 | B2 | * | 10/2010 | Warren | 450/39 |

* cited by examiner

*Primary Examiner* — Gloria Hale
(74) *Attorney, Agent, or Firm* — Shook, Hardy & Bacon L.L.P.

(57) ABSTRACT

A bra with embroidered support regions that provide support without compression is provided. The embroidered support regions are constructed by stitching a configurable thread pattern on a middle layer of a bra cup. The configurable thread pattern includes a plurality of top threads and a plurality of bobbin threads that are arranged to provide support in needed areas.

19 Claims, 4 Drawing Sheets

BRA WITH EMBROIDERED SUPPORT REGIONS

FIELD

The present disclosure relates to a bra with embroidered support regions. Specifically, the present disclosure relates to a bra cup having an embroidered middle layer that provides support without compression through the use of configurable thread patterns.

BACKGROUND

Conventional bras, especially sport bras, typically provide support by using materials or fabrics that compress the entire chest area. Moderate to high amounts of compression may be uncomfortable to the wearer and may also restrict movement. Further, the compression is not localized to only those areas that typically need support. Bras may also provide support through the use of wire underwires. These underwires can cause discomfort by pressing uncomfortably into the wearer's flesh. As well, the tip of the underwire may penetrate its casing and cause chaffing or other discomfort.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, the present invention is directed towards a bra that provides support through the use of an embroidered middle layer having a configurable thread pattern. The thread pattern may be configured to distribute more support in some areas and less support in other areas. Further, the areas of support may be visually apparent to a wearer through the use of a semi-transparent external-facing layer that enables the wearer to view the embroidered middle layer. This feature enables the wearer to select a bra with a thread pattern optimized to provide customized support.

Accordingly, in one aspect, the present invention provides a bra cup with embroidered support regions. The bra cup comprises a first layer of material comprising an external-facing layer of the bra cup when in an as-worn position and a second layer of material comprising an internal-facing layer of the bra cup when in an as-worn position. The bra cup further comprises a third layer of material disposed between the first layer and the second layer. The third layer of material has a thread pattern on at least a portion of the third layer. The thread pattern is stitched using a plurality of top threads and a plurality of bobbin threads, and the thread pattern is completely covered by the first layer of material and the second layer of material.

In another aspect, a process of making a bra cup with embroidered support regions is provided. The process comprises preparing an interior liner layer of the bra cup and preparing an exterior shell layer of the bra cup. A middle embroidered layer is prepared by stitching a thread pattern on at least a portion of the middle embroidered layer. The thread pattern has a plurality of top threads and a plurality of bobbin threads. Each top thread of the plurality of top threads and each bobbin thread of the plurality of bobbin threads extend across a portion of the middle embroidered layer. The process further comprises attaching to each other the interior liner layer, the exterior shell layer, and the middle embroidered area.

In yet another aspect, a bra with embroidered support regions is provided. The bra comprises a front region that covers a wearer's breasts and at least a portion of the wearer's torso when the bra is worn. The front region comprises at least a pair of breast cups, where each breast cup comprises an external-facing layer and an internal-facing layer when the bra is in an as-worn position. Each breast cup further comprises a material layer disposed between the external-facing layer and the internal-facing layer. Additionally, each breast cup comprises at least one stitched thread pattern attached to the material layer, where the at least one stitched thread pattern has a plurality of top threads and a plurality of bobbin threads. The at least one stitched thread pattern is configured to provide a support region for the each breast cup. The bra also comprises a back region that is attached to the front region of the bra.

BRIEF DESCRIPTION OF THE DRAWINGS

Examples of the present invention are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

The present invention is directed towards a bra that provides support through the use of an embroidered middle layer having a configurable thread pattern. The thread pattern may be configured to distribute more support in some areas and less support in other areas. Further, the areas of support may be visually apparent to a wearer through the use of a semi-transparent external-facing layer that enables the wearer to view the thread pattern. This feature enables the wearer to select a bra with a thread pattern optimized to provide customized support.

Figure 1:
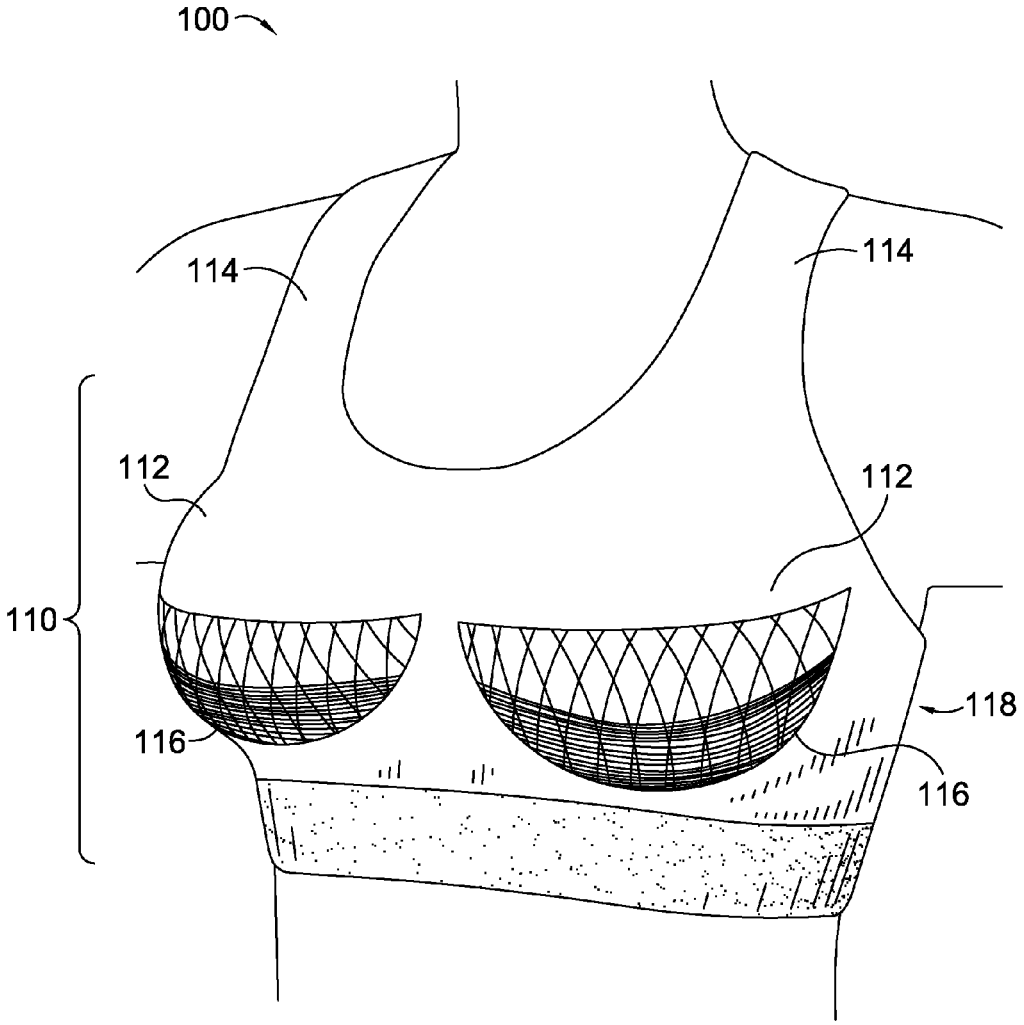
FIG. 1 depicts a perspective view of a bra with embroidered support regions in an as-worn position in an aspect of the present invention.

FIG. 1 illustrates a person wearing a bra 100 with embroidered support regions. While aspects discussed herein refer to bras, it will be understood that aspects are not limited to any particular style or type of support garment used to support breast tissue. For example, other support garments may include camisoles, swimwear or other garments with built-in support. Further, the depictions in the drawings are for exemplary purposes only and are in no way meant to limit the scope of the present invention.

The bra 100 includes a front region 110, breast cups 112, shoulder straps 114, embroidered support areas or regions 116, and a back region 118. The shoulder straps 114 may have a number of different configurations such as racerback, convertible, standard, and the like. The back region 118 is connected to the front region 110 in part through the shoulder straps 114. As well, the bra 100 may have a front closure, a back closure, or the bra 100 may be donned by pulling the bra 100 over the wearer's head.

The front region 110 of the bra 100 is the portion of the bra that covers a portion of the torso of the wearer including the wearer's breasts. The front region 110 may include the pair of breast cups 112 which, in some aspects, may be structured or constructed such that they conform generally to the shape of the wearer's breasts. The breast cups 112 may be constructed of several layers of material. By way of example, the breast cups 112 may include an inner liner layer or internal-facing layer that comes in contact with the wearer's skin when the bra 100 is worn, an external shell layer or external-facing layer that is on the exterior of the bra 100 when the bra 100 is worn, and a middle layer disposed between the exterior layer and the interior layer. The middle layer may have one or more embroidered thread patterns that, in one aspect, may be completely covered by the exterior layer and the interior layer. Further, as shown in FIG. 1, the external shell layer may be transparent or semi-transparent such that the thread pattern on the middle layer is visible or partially visible through the external shell layer. In another aspect, the external shell layer may be opaque such that the thread pattern is not visible through the external shell layer. Any and all such aspects, and any combination thereof, are contemplated as being within the scope of the invention.

The embroidered support regions 116 may have any number of different configurations depending on support needs. For instance, as shown in FIG. 1, the embroidered support regions 116 may be configured to provide support and/or lift to the under portion of the wearer's breasts. Other configurations of thread patterns are possible. For example, another configuration of thread patterns may provide support and/or lift to the under portion of the wearer's breast as well as to a lateral portion of the wearer's breasts (e.g. that portion of the wearer's breasts below the wearer's underarms). Yet another configuration may provide support and/or lift to the under portion and the lateral portion of the wearer's breasts as well as to a medial portion of the wearer's breasts (e.g. that portion of the wearer's breasts near the midline of the body). The configuration of the embroidered support regions 116 may be the same for both breast cups 112, or the configuration of the embroidered support regions 116 may differ for each of the breast cups 112. For instance, a wearer may have the option to customize the bra 100 to provide individualized support portions for each breast. Any and all such aspects, and any combination thereof, are contemplated as being within the scope of the invention.

Figure 6:
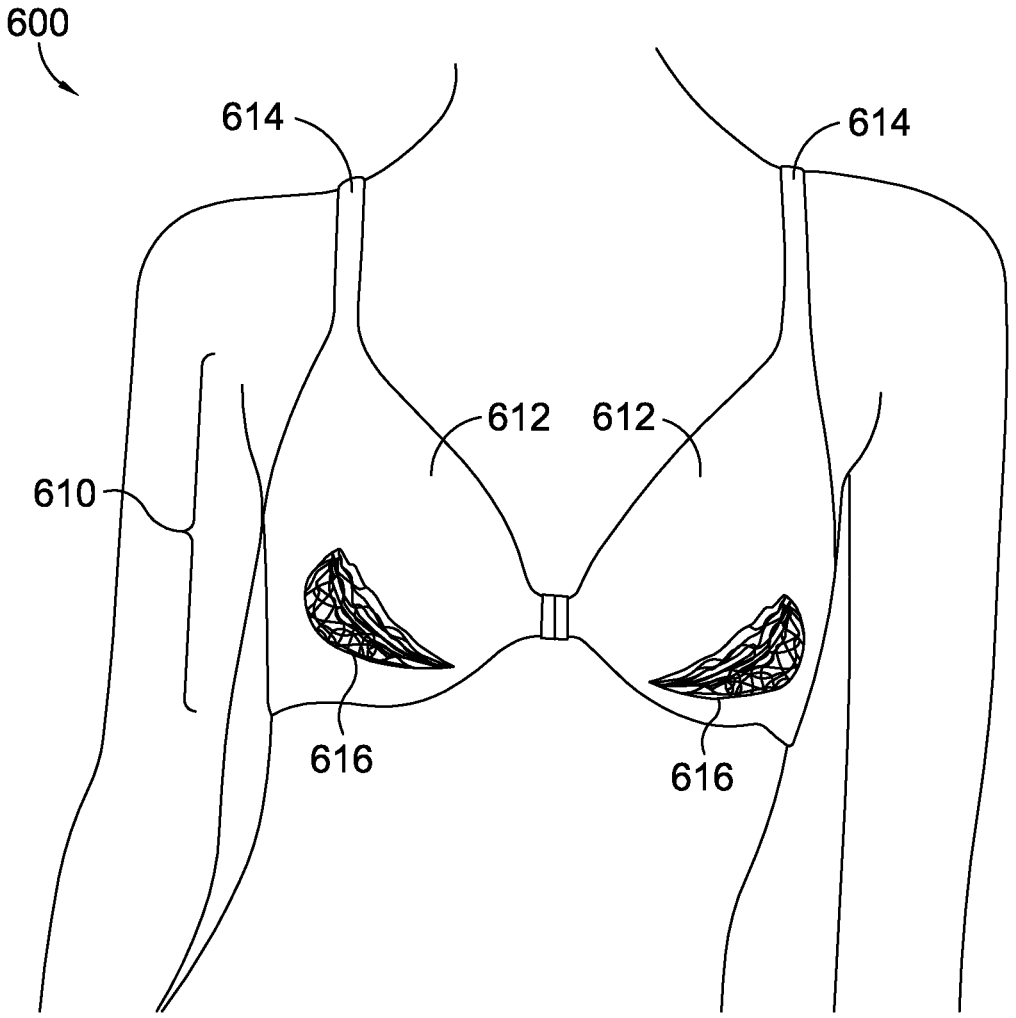
FIG. 6 depicts a perspective view of a bra with embroidered support regions in an as-worn position in an aspect of the present invention.

FIG. 6 depicts another view of a bra 600 that includes a front region 610, breast cups 612, shoulder straps 614, and embroidered support areas or regions 616. The bra 600 may have a front closure as shown, although additional closure systems are contemplated. Like the bra 100 of FIG. 1, the front region 610 of the bra 600 is the portion of the bra that covers a portion of the torso of the wearer including the wearer's breasts.

The breast cups 612 may be constructed of several layers of material. By way of example, the breast cups 612 may include an inner liner layer or internal-facing layer that comes in contact with the wearer's skin when the bra 600 is worn, an external shell layer or external-facing layer that is on the exterior of the bra 600 when the bra 600 is worn, and a middle layer disposed between the exterior layer and the interior layer. The middle layer may have one or more embroidered thread patterns (e.g., the embroidered support areas 616) that, in one aspect, may be completely covered by the exterior layer and the interior layer. Further, as shown in FIG. 6, the external shell layer may be transparent or semi-transparent such that the thread pattern on the middle layer is visible or partially visible through the external shell layer. In another aspect, the external shell layer may be opaque such that the thread pattern is not visible through the external shell layer. Any and all such aspects, and any combination thereof, are contemplated as being within the scope of the invention.

As shown if FIG. 6, the embroidered support regions 616 have a sling-like configuration. Such a configuration is useful for preventing back-and-forth breast movement combined with up-and-down breast movement that many women experience when performing athletic activities such as running. The sling-like configuration of the embroidered support regions 616 provides support mainly at the lateral portion of the breast and the under portion of the breast when the bra 600 is worn to help decrease this type of breast movement. The thread configuration shown in FIG. 6 is merely exemplary. Other thread configurations designed to provide different types of support are contemplated as being within the scope of the invention.

Figure 2:
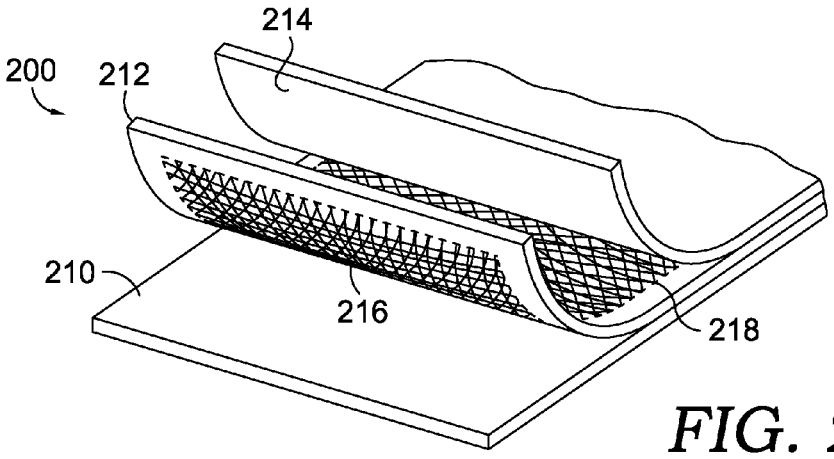
FIG. 2 depicts a cross-sectional view of layers of a bra cup including an embroidered middle layer in an aspect of the present invention.

Turning now to FIG. 2, a cross-sectional view of a portion of a bra cup (such as the bra cup 112 of FIG. 1) is shown and is referenced generally by the numeral 200. The bra cup 200 includes an external-facing layer or exterior shell layer 210, a middle layer 212 having top threads 216 and bobbin threads 218 embroidered in a thread pattern, and an internal-facing layer 214. The external shell layer 210 faces the exterior of the wearer when the bra is worn, while the internal-facing layer 214 is adjacent to the wearer's skin when the bra is worn. The middle layer 212 is disposed between the external-facing layer 210 and the internal-facing layer 214. Although only three layers are shown, it is contemplated that the bra cup may comprise more than three layers. Some of these layers may be functional layers. For example, a layer may comprise an insert that shapes, supports, and/or molds the breasts of the wearer when the bra is worn.

In one aspect, the textiles used for the layers 210, 212, and 214 may be manufactured through any type of knitting, such as warp knitting or weft knitting, and/or weaving. Exemplary weave patterns may comprise Tricot weave, plain weave, satin weave, twill weave, basket weave, jacquard weave, and the like. The fabric types or textiles used for the layers 210, 212, and 214 in accordance with the present invention may comprise man-made and/or natural fibers. Exemplary natural fibers may comprise cotton, silk, wool, flax, and/or hemp, while exemplary man-made fibers may include polyester, nylon, rayon, spandex, and/or rubber. The fibers that make up the different fabric types may comprise a plurality of different sizes and may have differing degrees of elasticity and/or stretch. Further, the fabrics used for the layers 210, 212, and/or 214 may be post-processed using known techniques to impart different properties to the layers 210, 212, and/or 214.

The layers 210, 212, and 214 may, in one aspect, all be constructed of the same textile. Alternatively, the layers 210, 212, and 214 may each be constructed of different textiles. Further, the layers 210, 212, and 214 may have the same or differing degrees of elasticity. Any and all such aspects, and any combination thereof, are contemplated as being within the scope of the invention. The external-facing layer 210 may be constructed of a material sufficiently lighter or transparent such that the thread pattern 216 is covered by the external-facing layer 210 but yet is still visible or partially visible through the external-facing layer 210. The layers 210, 212, and 214 may be affixed together along, for example, the perimeter of the bra cup 200 using known affixing technologies such as stitching, adhesives, tacking, spot welding, ultrasound, light, heat, lamination, and the like. As well, the layers 210, 212, and 214 may also be affixed to each other in different areas besides the perimeter. Any and all such aspects, and any variation thereof, are contemplated as being within the scope of the invention.

The internal-facing layer 214 may have a degree of rigidity or stiffness that is greater than the layers 210 and 212. This extra degree of stiffness may provide structure to the bra cup 200. The stiffness may be generated by an insert and/or by the type of material used to prepare the internal-facing layer 214. Additionally, or alternatively, the stiffness may be generated by treating the material used to prepare the internal-facing layer 214 using techniques known in the art. As well, the internal-facing layer 214 may be constructed using techniques known in the art to provide structure to the bra cup 200.

The middle layer 212 is embroidered using known techniques such as machine embroidery to construct a thread pattern. A thread pattern constructed using machine embroidery may comprise both the bobbin threads 218 and the top threads 216. Alternatively, the middle layer 212 may be embroidered by hand using a single thread. Although both embroidery methods are contemplated, much of the following discussion is in the context of machine embroidery utilizing both the bobbin threads 218 and the top threads 216. Exemplary thread materials may comprise cotton, man-made, polyester, cotton-wrapped polyester, linen, filament polyester, silk, and the like. One specific example of thread material is Coats Eloflex thread manufactured by Coats. Coats Eloflex is a synthetic fiber made from polybutylene terephthalate (PBT).

The threads 216 and 218 may be composed of materials that are more or less elastic than the materials that make up the layers 210, 212, and/or 214. For example, in one aspect, the threads 216 and/or 218 may be more elastic than the materials that make up the layers 210, 212, and/or 214. In another aspect, the threads 216 and/or 218 may be less elastic than the materials that make up the layers 210, 212, and/or 214. Any and all such aspects, and any combination thereof, are contemplated as being within the scope of the invention.

The bobbin threads 218 may be composed of the same type of thread material as the top threads 216, or, alternatively, the bobbin threads 218 may be composed of a different type of thread material as the top threads 216. As well, a portion of the top threads 216 and/or the bobbin threads 218 may comprise thread materials having different properties than the remaining portions of the top threads 216 and/or bobbin threads 218. For example, a portion of the top threads 216 and/or bobbin threads 218 may comprise thread materials of a greater diameter, lesser diameter, different coloring, more elasticity, and/or less elasticity than the remaining portions of the top threads 216 and/or bobbin threads 218.

The top threads 216 and/or the bobbin threads 218 may be the same or different color than the layers 210, 212, and/or 214. As well, the top threads 216 and/or the bobbin threads 218 may be multi-colored or a single uniform color. In one aspect, different colors may be used to signify different properties associated with the thread materials. For instance, one color may be used to indicate a portion of the thread pattern embroidered using a more elastic thread material, and a second color may be used to indicate a portion of the thread pattern embroidered using a less elastic thread material. In an additional aspect, different colors may be used to indicate different zones of the thread pattern. For example, a first color may be used to indicate an under-breast support zone, and a second color may be used to indicate a lateral support zone. Any and all such aspects, and any combination thereof, are contemplated as being within the scope of the invention.

As shown in FIG. 2, the top threads 216 face the external-facing layer 210, and the bobbin threads 218 face the internal-facing layer 214. In another exemplary arrangement, the top threads 216 face the internal-facing layer 214, and the bobbin threads 218 face the external-facing layer 210. In one aspect, the top threads 216 and the bobbin threads 218 may be completely covered by the external layer 210 and/or the internal layer 214 such that no part of the thread pattern is exposed either externally or next to the wearer's skin.

In one aspect of the invention, a portion of the fabric of the middle layer 212 that lies between the top threads 216 and the bobbin threads 218 may be removed (e.g., by cutting, lasering, burning, and the like) leaving a sufficient remaining portion of the middle layer 212 (or perimeter of the middle layer 212) by which the top threads 216 and the bobbin threads 218 remain securely attached to the middle layer 212. The remaining portion of the middle layer 212 is subsequently attached to the external layer 210 and the internal layer 214 as explained above. The removal of the portion of the fabric of the middle layer 212 between the top threads 216 and the bobbin threads 218 may occur before and/or after the thread pattern is embroidered.

Figure 3:
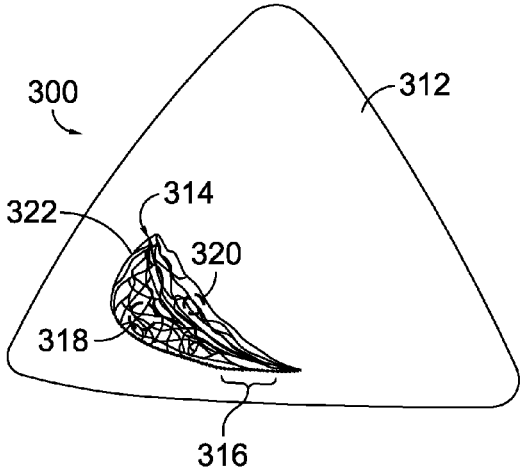
FIG. 3 depicts a front view of a plurality of top threads in a configured thread pattern on a middle layer of a bra cup in an aspect of the present invention.

FIG. 3 depicts a front view of an embroidered middle layer of a bra cup 300. The shape of the bra cup 300 is exemplary and other shapes are contemplated as being within the scope of the invention. The embroidered middle layer of the bra cup 300 is constructed from a material 312 and a plurality of bobbin threads 314 embroidered in a thread pattern on the material 312 using known embroidery techniques. The bobbin threads 314 may face an internal-facing layer of a bra cup 300 such as the internal-facing layer 214 of FIG. 2. The material 312 may be manufactured through any type of knitting and/or weaving. The material 312 may be constructed of man-made or natural fibers as described above. The bobbin threads 314 may be composed of a thread material such as cotton, polyester, man-made, cotton-wrapped polyester, linen, filament polyester, silk, and the like. The elasticity of the bobbin threads 314 may be more, less, or the same elasticity as compared to the elasticity of the material 312. Further, the bobbin threads 314, or a portion of the bobbin threads 314, may be the same color or a different color than the material 312.

As shown, the bobbin threads 314 are stitched onto the material 314 (e.g., at points 316) to produce the thread pattern. Further, the bobbin threads 314 are secured through the use of a throw stitch 322. Other ways of securing the bobbin threads 314 are contemplated such as adhesives, seam tape, spot welding, ultrasound, and the like. In one aspect, the bobbin threads 314 may be embroidered to impart a degree of laxity to the bobbin threads 314 when the bra is not being worn by the wearer. This laxity may be important in enabling the wearer to put the bra on by, for example, pulling the bra on over the wearer's head in some possible configurations. However, other ways of putting on the bra such as by front closure or back closure are contemplated as being within the scope of the invention. When the bra is in an as-worn position as in FIG. 1, the bobbin threads 314 may be taut to provide support. The thread pattern may include areas of greater density of bobbin threads 314 as shown by demarcated area 318. Areas with greater density of bobbin threads 314 may provide greater support as compared to areas that have a lesser density of bobbin threads 314 such as, for example, demarcated area 320. With respect to FIG. 3, the area 318 is located adjacent to or towards the bottom and lateral margin of the bra cup 300 to provide support to the under portion and the lateral portion of the wearer's breasts.

As can be seen with respect to FIG. 3, each of the bobbin threads 314 extends across a portion of the bra cup 300 in both a side-to-side aspect (e.g., a lateral to medial aspect) and a top-to-bottom aspect (e.g., a superior to inferior aspect). In one exemplary aspect, the bobbin threads 314 may extend across approximately 75% of the bra cup 300 in a side-to-side and/or a top-to-bottom aspect. In other exemplary aspects, the bobbin threads 314 may extend across approximately 50%, 40%, 30%, 20% or 10% of the bra cup 300 in a side-to-side and/or a top-to-bottom aspect. Further, the bobbin threads 314 may extend across a different percentage of the bra cup 300 in a side-to-side aspect as compared to a top-to-bottom aspect. Any and all such aspects, and any combination thereof, are contemplated as being within the scope of the invention.

Figure 4:
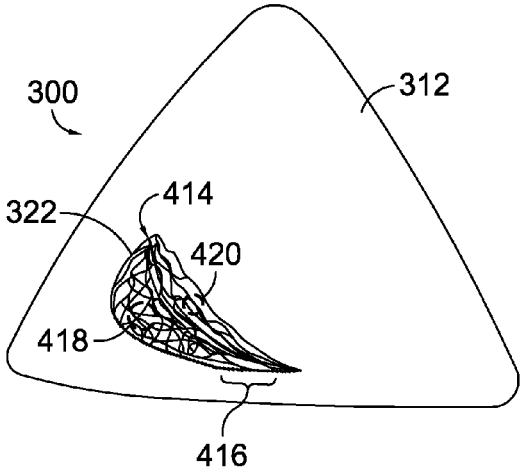
FIG. 4 depicts a front view of a plurality of bobbin threads in a configured thread pattern on the middle layer of the bra cup in an aspect of the present invention.

FIG. 4 depicts a back view of the embroidered middle layer of the bra cup 300 and includes the material 312 and a plurality of top threads 414. The top threads 414 face the external-facing layer of the bra cup 300 when the bra is in an as-worn position. The top threads 414 may be comprised of the same thread material as the bobbin threads 314 of FIG. 3, or the top threads 414 may be comprised of a different thread material as the bobbin threads 314. The elasticity of the top threads 414 may be more, less, or the same elasticity as compared to the elasticity of the material 312. As well, the elasticity of the top threads 414 may be more, less, or the same elasticity as the bobbin threads 314. The top threads 414, or a portion of the top threads 414, may be the same or a different color than the material 312. As well, the top threads 414 may be all of one color, or the top threads 414 may be multicolored to create a variable-colored thread pattern. Further, the top threads 414 may have different colors to signify different zones and/or different thread material properties. Any and all such aspects, and any variation thereof, are contemplated as being within the scope of the invention.

The top threads 414 are affixed to the material 312 via the bobbin threads 314 (e.g., at points 416) to produce the thread pattern. The top threads 414 are secured through the use of the throw stitch 322. Other ways of securing the top threads 414 are contemplated. For example, the top threads 414 may be secured through the use of seam tape, adhesives, spot welding, heat, light, and the like. Like the bobbin threads 314, the top threads 414 may be stitched to have a degree of laxity when the bra is not being worn and are contemplated as being taut when the bra is worn. As well, the top threads 414 have areas of greater density as shown by demarcated area 418 and areas of lesser density as shown by demarcated area 420. The area of greater density 418 provides a greater degree of support as compared to the area of lesser density 420. Because of the nature of embroidery, the configuration or arrangement of the top threads 414 generally mirrors the configuration or arrangement of the bobbin threads 314.

Like the bobbin threads 314 of FIG. 3, each of the top threads 414 extends across a portion of the bra cup 300 in both a side-to-side aspect (e.g., a lateral to medial aspect) and a top-to-bottom aspect (e.g., a superior to inferior aspect). In one exemplary aspect, the top threads 414 may extend across approximately 75% of the bra cup 300 in a side-to-side and/or a top-to-bottom aspect. In other exemplary aspects, the top threads 414 may extend across approximately 50%, 40%, 30%, 20% or 10% of the bra cup 300 in a side-to-side and/or a top-to-bottom aspect. Further, the top threads 414 may extend across a different percentage of the bra cup 300 in a side-to-side aspect as compared to a top-to-bottom aspect. Any and all such aspects, and any combination thereof, are contemplated as being within the scope of the invention.

Figure 5:
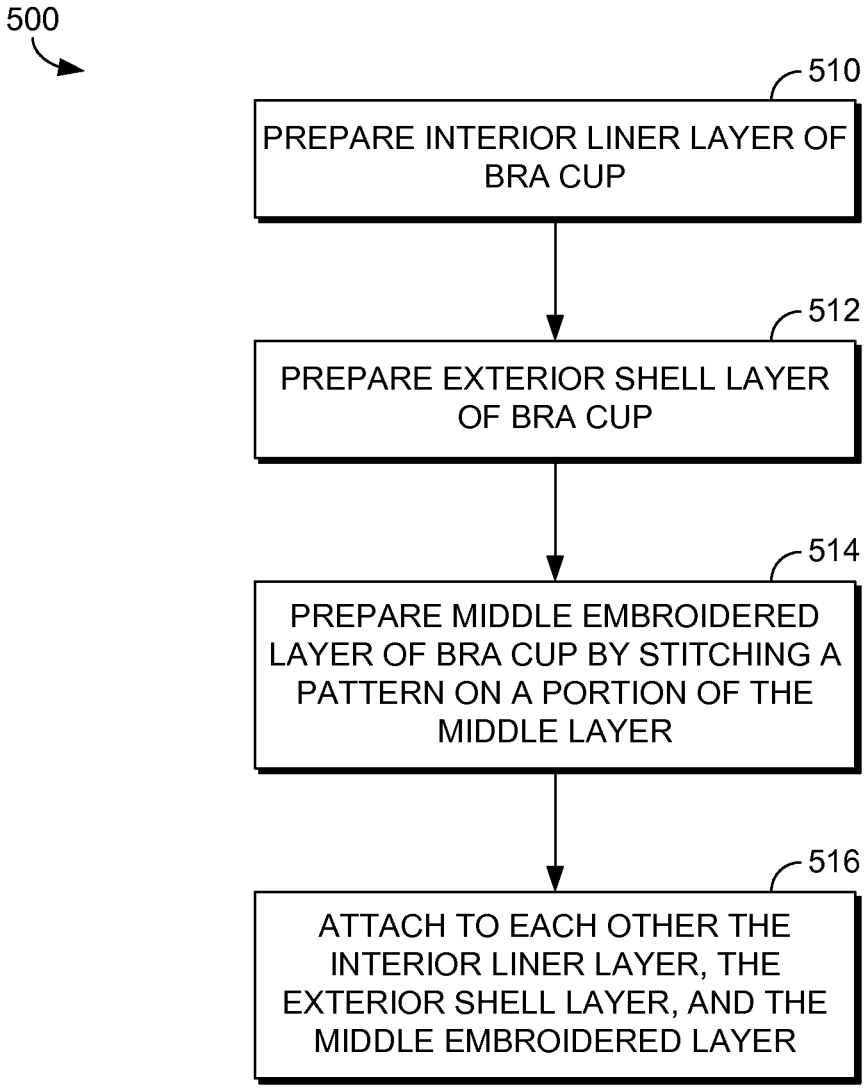
FIG. 5 depicts a flow diagram illustrating an exemplary process for fabricating a bra cup with embroidered support regions in accordance with an aspect of the present invention.

Turning now to FIG. 5, a flow diagram is depicted illustrating an exemplary method 500 of constructing a bra cup with embroidered support portions in accordance with an aspect of the present invention. At a step 510, an interior liner layer of the bra cup is prepared. The interior liner layer is the layer that is adjacent to the wearer's skin when the bra is in an as-worn position. The interior liner layer may be manufactured through any type of knitting and/or weaving and may comprise man-made or natural materials. The material chosen for the interior liner layer may have a degree of stiffness to impart some structure to the bra cup. In one aspect, the interior liner layer may be prepared by constructing the layer to conform to the general shape of the wearer's breast using techniques known in the art.

At a step 512, an exterior shell layer of the bra cup is prepared. The exterior shell layer is the layer that faces externally when the bra is in an as-worn position. The exterior shell layer may be manufactured by any type of knitting and/or weaving and may comprise natural and/or man-made materials. The exterior shell layer may be constructed from the same type of fabric material and/or knit/weave pattern as the interior liner layer, or the exterior shell layer may be constructed from a different type of fabric material and/or knit/weave pattern as the interior liner layer. The material used to construct the exterior shell layer may have a degree of transparency such that a thread pattern on a middle layer may be visible or partially visible through the exterior shell layer.

At a step 514, a middle embroidered layer of the bra cup is prepared by stitching a thread pattern on at least a portion of the middle layer material. The middle embroidered layer may be manufactured through any type of knitting and/or weaving and may comprise man-made and/or natural materials.

The thread pattern is comprised of a plurality of top threads and a plurality of bobbin threads that extend across a portion of the bra cup as set forth above. The top threads and the bobbin threads may comprise thread materials such as cotton, man-made, polyester, cotton-wrapped polyester, linen, filament polyester, silk, and the like. The thread materials may have an elasticity that is greater or less than an elasticity associated with the inner liner layer, the external shell layer, and/or the middle embroidered layer. Further, the top threads and the bobbin threads may, in one aspect, be stitched to impart a degree of laxity to the threads when the bra is not being worn. The thread pattern, in one aspect, may be completely covered by the exterior shell layer and/or the interior liner layer such that the thread pattern is not exposed either on the external face of the bra or the internal face of the bra. Once the thread pattern is stitched, the top threads and the bobbin threads may be secured by a single throw stitch around the perimeter of the thread pattern to tack down the thread edges.

Other ways of securing the threads are contemplated such as adhesives, seam tape, spot welding, ultrasound, and the like.

The thread pattern is configurable to provide customized support portions. Support portions may be located adjacent to the bottom margin of the bra cup, the lateral margin of the bra cup, and/or the medial margin of the bra cup. Any and all such aspects, and any combination thereof, are contemplated as being within the scope of the invention. In one aspect, the support portions may be constructed by increasing the density of the top threads and/or the bobbin threads in these areas.

At a step 516, the interior liner layer, the exterior shell layer, and the middle embroidered area are attached to each other. Attachment may be along the perimeter or other areas of the bra cup and may be accomplished using various affixing technologies known in the art such as stitching, tacking, spot welding, ultrasound, heat, light, adhesives, and the like.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A bra cup with embroidered support regions, the bra cup comprising:

a first layer of material comprising an external-facing layer of the bra cup when in an as-constructed position;

a second layer of material comprising an internal-facing layer of the bra cup when in the as-constructed position; and a third layer of material disposed between the first layer and the second layer, the third layer of material having a first surface facing the first layer of material when the bra cup is in the as-constructed arrangement and a second surface facing the second layer of material when the bra cup is in the as-constructed arrangement, the third layer of material having an embroidery pattern stitched onto at least a portion of the third layer, the embroidery pattern stitched using a plurality of top threads located on the first surface and a plurality of bobbin threads located on the second surface, wherein the embroidery pattern is completely covered by the first layer of material and the second layer of material when the bra cup is in the as-constructed arrangement, and wherein the first layer, the second layer, and the third layer of materials are affixed together along at least a perimeter of the bra cup when the bra cup is in the as-constructed arrangement.

2. The bra cup of claim 1, wherein the first layer of material is semi-transparent.

3. The bra cup of claim 1, wherein the first layer of material has a first degree of stiffness, the second layer of material has a second degree of stiffness, and the third layer of material has a third degree of stiffness, and wherein the second degree of stiffness is greater than the first degree of stiffness and the third degree of stiffness.

4. The bra cup of claim 1, wherein the first layer, the second layer and the third layers of materials are manufactured by knitting.

5. The bra cup of claim 1, wherein the plurality of top threads is a different color than the first layer of material and the third layer of material.

6. The bra cup of claim 1, wherein the plurality of top threads is multi-colored.

7. The bra cup of claim 1, wherein the plurality of top threads comprises at least one of cotton, man-made, spun polyester, cotton-wrapped polyester, filament polyester, or silk.

8. The bra cup of claim 1, wherein the plurality of top threads is formed from elastic threads, and wherein the plurality of top threads has a degree of elasticity that is less than a degree of elasticity associated with one or more of the first, second, or third layers of materials.

9. The bra cup of claim 1, wherein the plurality of top threads is formed from elastic threads, and wherein the plurality of top threads has a degree of elasticity that is greater than a degree of elasticity associated with one or more of the first, second, or third layers of materials.

10. The bra cup of claim 1, wherein the first, second and third layers of material are adhered together to form in part a front region of a bra that supports and covers a wearer's breasts and at least a portion of the wearer's torso when the bra is worn.

11. A bra cup with embroidered support regions made by a process comprising the steps of:

preparing an interior liner layer of the bra cup;

preparing an exterior shell layer of the bra cup;

preparing a middle embroidered layer of the bra cup by stitching an embroidery pattern on at least a portion of the middle embroidered layer, the thread pattern having a plurality of top threads on a first surface of the middle embroidered layer and a plurality of bobbin threads on a second surface of the middle embroidered layer, wherein each top thread of the plurality of top threads and each bobbin thread of the plurality of bobbin threads extend across a portion of the middle embroidered layer; and forming the bra cup by attaching to each other the interior liner layer, the exterior shell layer, and the middle embroidered layer.

12. The process of claim 11, wherein the interior liner layer, the exterior shell layer, and the middle embroidered layer are attached using at least one of stitching, adhesive, lamination, or heat press.

13. The process of claim 11, wherein the interior liner layer, the exterior shell layer, and the middle embroidered area are attached along a perimeter of the interior liner layer, the exterior shell layer, and the middle embroidered area.

14. The process of claim 11, wherein the plurality of top threads is unevenly distributed on the at least the portion of the middle embroidered layer.

15. The process of claim 11, wherein the plurality of top threads is most dense at a lower edge of the bra cup.

16. The process of claim 11, wherein the plurality of top threads is stitched to provide a degree of laxity to the plurality of bobbin threads.

17. A bra with embroidered support regions comprising:

a front region that covers a wearer's breasts and at least a portion of the wearer's torso when the bra is worn, the front region comprising at least a pair of breast cups, each breast cup of the pair of breast cups comprising an external-facing layer and an internal-facing layer when the bra is in an as-worn position, the each breast cup further comprising a material layer disposed between the external-facing layer and the internal-facing layer, the each breast cup further comprising at least one stitched embroidery pattern attached to the material layer, the at least one stitched embroidery pattern having a plurality of top threads on a top surface of the material layer and a plurality of bobbin threads on a bottom surface of the material layer, the at least one stitched embroidery pattern configured to provide a support region for the each breast cup; and a separate back region attached to the front region of the bra and adapted to cover at least a portion of the wearer's back when the bra is worn.

18. The bra of claim 17, further comprising utilizing a pair of shoulder straps to connect the front and back regions of the bra.

19. The bra of claim 17, wherein the plurality of top threads faces the external-facing layer.

* * * * *